United States Patent [19]

Kai et al.

[11] Patent Number: 4,995,497

[45] Date of Patent: Feb. 26, 1991

[54] COIN DISCRIMINATION APPARATUS

[75] Inventors: Osamu Kai; Masaaki Tsukada; Hiroshi Tachibana, all of Tokyo, Japan

[73] Assignee: Tamura Electric Works, Ltd., Japan

[21] Appl. No.: 68,563

[22] Filed: Jun. 30, 1987

[30] Foreign Application Priority Data

Jul. 21, 1986 [JP] Japan ..... 61-171419

[51] Int. Cl.[5] ..... G07D 5/08

[52] U.S. Cl. ..... 194/318; 324/227; 324/236

[58] Field of Search ..... 194/317, 318, 319, 334, 194/335; 324/227, 234, 236, 239, 243, 262; 73/163; 209/567, 571

[56] References Cited

U.S. PATENT DOCUMENTS

| | | | |
|---|---|---|---|
| 3,870,137 | 3/1975 | Fougere . | |
| 4,124,111 | 11/1978 | Hayashi | 194/319 X |
| 4,385,684 | 5/1983 | Sugimoto et al. | 194/318 |
| 4,462,513 | 7/1984 | Dean et al. | 194/318 |
| 4,488,116 | 12/1984 | Plesko | 194/319 X |
| 4,601,380 | 7/1986 | Dean et al. | 194/318 |
| 4,660,705 | 4/1987 | Kai et al. | 194/318 |
| 4,705,154 | 11/1987 | Masho et al. | 194/319 |

FOREIGN PATENT DOCUMENTS 0500263 2/1983 Japan .

*Primary Examiner*—H. Grant Skaggs
*Assistant Examiner*—Steven Kennemore
*Attorney, Agent, or Firm*—Perman & Green

[57] ABSTRACT

A coin discrimination apparatus discriminates authenticity and a denomination of a coin by oscillation magnetic fields of high and low frequencies in a low frequency band in which generated magnetic fluxes allow a coin to pass therethrough. A first oscillation coil for generating an oscillation magnetic field of a low frequency and a reception coil are arranged at coin contact and coin non-contact surfaces, respectively, of an inclined coin path to face each other. A second oscillation coil is arranged on the coin non-contact surface to be separated from the reception coil by a predetermined distance in a coin rolling direction and generates an oscillation magnetic field of a high frequency. The coin discrimination apparatus includes a first sensor circuit for detecting maximum values of changes in impedances of the oscillation coils and the reception coil upon passage of a coin, a second sensor circuit for detecting the changes in impedances when the changes in impedances of the first and second oscillation coils coincide with each other, and a CPU for discriminating authenticity and the denomination of the coin based on coin physical characteristics in accordance with the detection results from the sensor circuits.

7 Claims, 6 Drawing Sheets

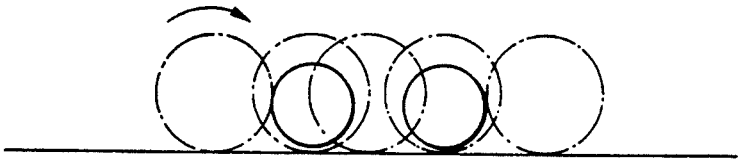
FIG.5
FIG.6 (a)
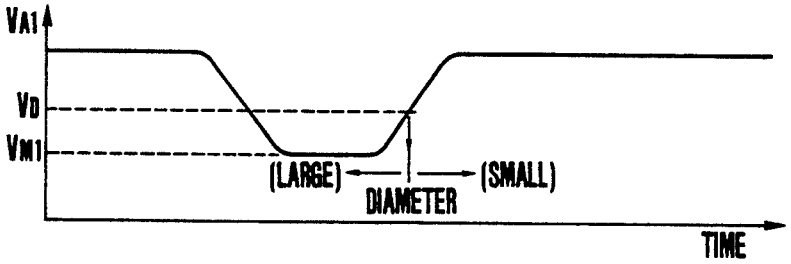
FIG.6 (b)
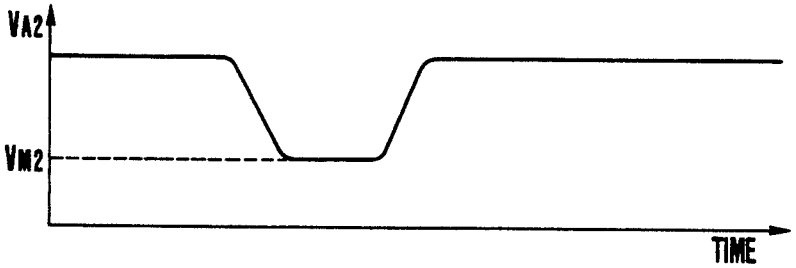
FIG.6 (c)
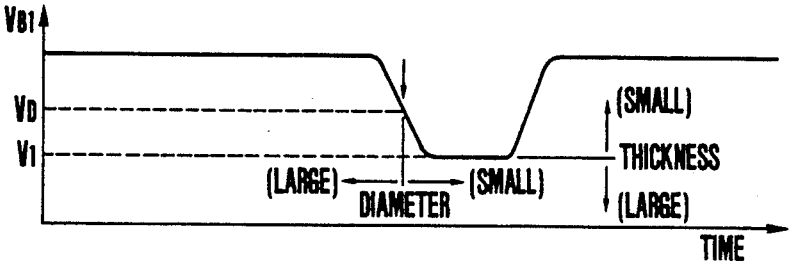

COIN DISCRIMINATION APPARATUS

BACKGROUND OF THE INVENTION

The present invention relates to a coin discrimination apparatus for discriminating authenticity and denominations of coins inserted in public telephones or various kinds of vending machines.

A coin discrimination apparatus of this type is disclosed in, e.g., International Publication No. WO82/02786 (corresponding to Japanese Patent Prepublication No. 58-500263). In this apparatus, discrimination is performed by utilizing oscillation magnetic fields respectively having high and low frequencies which are low enough to allow a coin to be discriminated to pass through magnetic fluxes generated thereby. In this case, a diameter and thickness of a coin are discriminated by the high-frequency magnetic field, while a material of the coin is discriminated by the low-frequency magnetic field. The diameter of coils for discriminating a thickness and a material is smaller than that of a smallest coin to be discriminated. A coil for discriminating a diameter has an elliptic shape having a major axis larger than a diameter of the smallest coin. Discrimination signals can be independently obtained for respective characteristics of a diameter, a thickness, and a material.

In the conventional coin discrimination apparatus described above, independent outputs can be obtained for the respective factors to be discriminated. However, the separate discrimination coils are used for independently discriminating the diameter, thickness, and material of a coin. In this case, a change in output is maximized near the center of each coil at which the magnetic flux is concentrated (i.e., the precision is highest near the center). Assume that coins of two different denominations which are of an identical material and have slightly different diameters are present. In this case, if some material is wound around the smaller-diameter coin to have the same diameter as that of the larger-diameter coin, these coins will be erroneously discriminated as an identical denomination with high probability.

SUMMARY OF THE INVENTION

A coin discrimination apparatus which discriminates authenticity and a denomination of a coin by oscillation magnetic fields of high and low frequencies in a low frequency band in which generated magnetic fluxes allow a coin to pass therethrough, comprising: a first oscillation coil, arranged at a coin contact surface of an inclined coin path, for generating an oscillation magnetic field of a low frequency; a reception coil arranged at a non-contact surface of the inclined coin path to face the first oscillation coil; a second oscillation coil, which is arranged on the coin non-contact surface to be separated from the reception coil by a predetermined distance in a coin rolling direction, for generating an oscillation magnetic field of a high frequency; maximum change detecting means for detecting respective values in relation to maximum values of changes in impedances of the oscillation coils and the reception coil upon passage of a coin; change detecting means for detecting a value in relation to changes in impedances of the first and second oscillation coils when the changes in the impedances thereof coincide with each other; and discriminating means for discriminating authenticity and the denomination of the coin based on coin physical characteristics in accordance with the detection results from the maximum change detecting means and the change detecting means.

BRIEF DESCRIPTION OF THE DRAWINGS

FIG. 5 is a view showing rolling movement of a coin;

FIGS. 6(*a*) to 6(*c*) are graphs showing outputs in the state shown in FIG. 5;

DESCRIPTION OF THE PREFERRED EMBODIMENT

Figure 1:
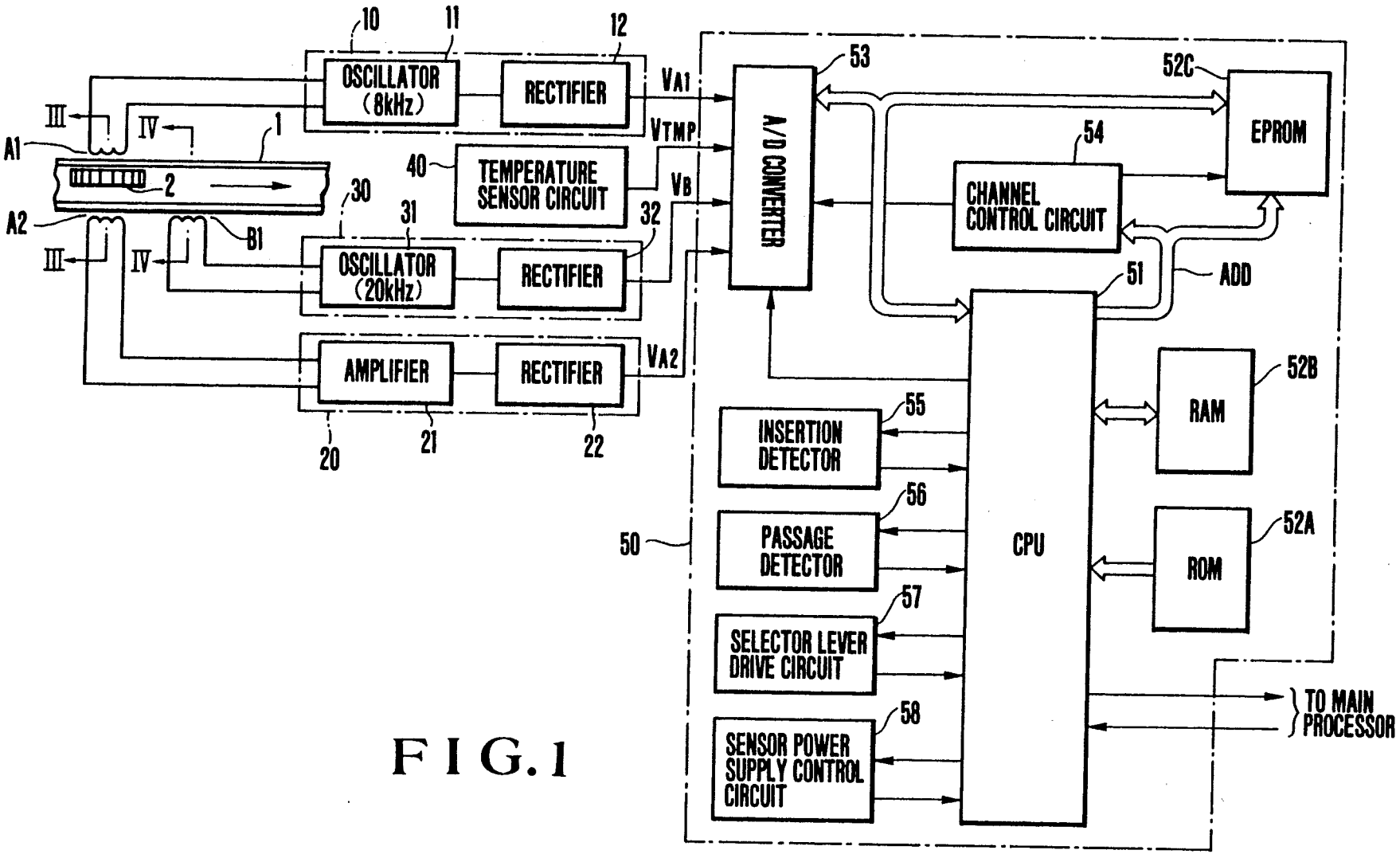
FIG. 1 is a block diagram showing an embodiment of the present invention.
Figure 2:
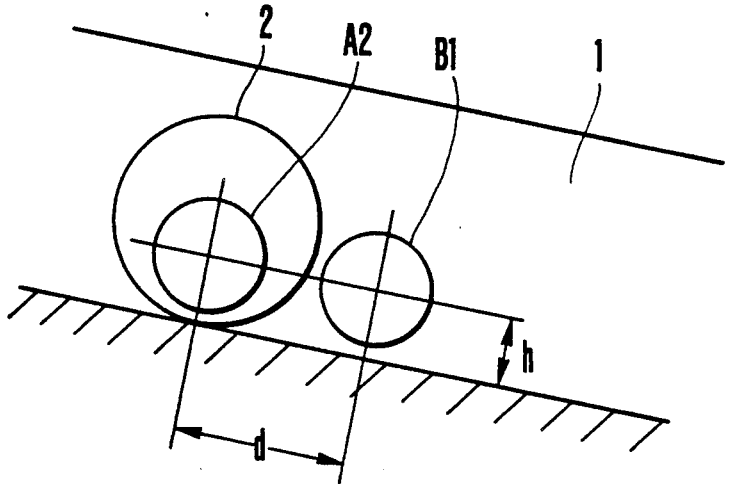
FIG. 2 is a side view when a coin path which is viewed from the above in FIG. 1 is viewed from the side.
Figure 3:
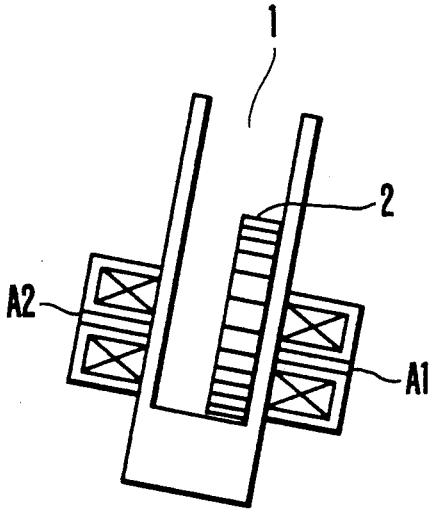
FIGS. 3 and 4 are respectively sectional views taken along lines III—III and IV—IV in FIG. 1.
Figure 4:
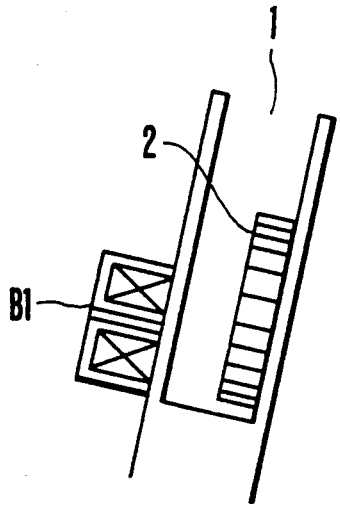

An embodiment of the present invention will now be described with reference to the accompanying drawings.

A first oscillation coil A1 for generating an oscillation magnetic field at a low frequency (in this embodiment 8 kHz) is arranged on the surface of a coin path 1 which contacts a coin 2. A reception coil A2 is arranged on the non-contact side of the coin 2 to face the coil A1. A second oscillation coil B1 for generating an oscillation magnetic field at a high frequency (within a frequency range which is low enough to allow a generated magnetic flux to pass through a coin; in this embodiment, 20 kHz) is arranged on the non-contact surface side of the path 1 with the coin 2 to be separated from the coil A2 by a predetermined distance in a rolling direction of the coin. In this embodiment, the low frequency is set at 8 kHz and the high frequency is set at 20 kHz. Although the frequency varies, the frequency boundary is set at 12 to 13 kHz. The high and low frequencies are determined by the material and the diameter of the coin to be discriminated.

In the positional relationship between the first oscillation coil A1 and the reception coil A2, and the second oscillation coil B1, the former coils are located on the upstream side along the rolling direction of the coin, and the latter coil is located on the downstream side in this embodiment. However, this relationship can be reversed in association with signal processing procedures (to be described later).

A distance d between the coils A1 and A2 and the coil B1 is set such that, when a coin is located at the center between the coils A1 and A2 and the coil B1, the outer periphery of the coin overlaps the detection ranges of both the coils A1 and B1 and more preferably a range wherein a large change in output can be obtained. The distance d varies in accordance with the height of each coil from the bottom surface of the coin path, and is influenced by the shape of the coil. In this embodiment, the diameter of a coin to be discriminated is assumed to fall within the range of 16 to 33 mm, and coils each of which has an outer diameter of 14 mm, a detection range diameter of 10 mm, and a diameter of 6 mm within which a particularly large change in output can be obtained, is arranged at a height h=9 mm from the bottom surface of the coin path and at a distance d of 22 mm.

Reference numerals 10 to 30 denote sensor circuits connected to the coils; 11 and 31, oscillators; 21, an amplifier; and 12, 22, and 32, rectifiers. Reference numeral 40 denotes a temperature sensor circuit for performing temperature correction. Based on the output from the sensor circuit 40, detection data is subjected to temperature correction.

The detection principle of respective characteristics of a coin, i.e., a material, a thickness, and a diameter, will now be described with reference to FIGS. 5 and 6.

When the rolling coin 2 passes through the detection surfaces of the coils A1 and A2 as shown in FIG. 5, the impedance of the coil A1 is changed in accordance with a material of the coin. Upon a change in impedance, the output amplitude of the oscillator 11 is also changed. Therefore, the amplitude of an output voltage $V_{A1}$ obtained by rectifying the output from the oscillator 11 is also changed as shown in FIG. 6(*a*). In this case, a minimum level (a maximum change) $V_{M1}$ is given as a material primary characteristic level.

On the other hand, an AC magnetic field excited by the coil A1 induces an AC voltage in the coil A2 through the coin 2. The amplitude of the excited AC voltage varies in accordance with the material of the coin. After the AC voltage is amplified, a minimum level $V_{M2}$ of a rectified output voltage $V_{A2}$ (FIG. 6(*b*)) is given as a material secondary characteristic level.

Figure 7A:
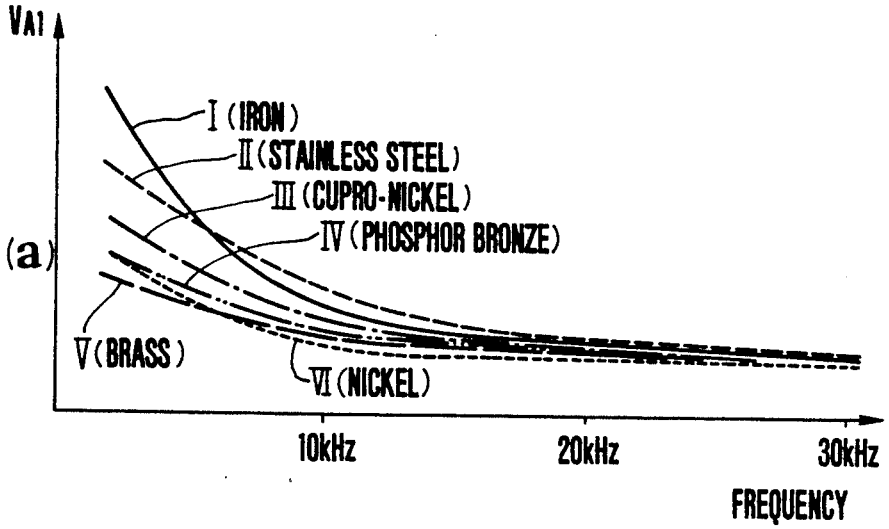
FIGS. 7(*a*) and 7(*b*) are graphs showing the frequency dependency of a material characteristic output.
Figure 7B:
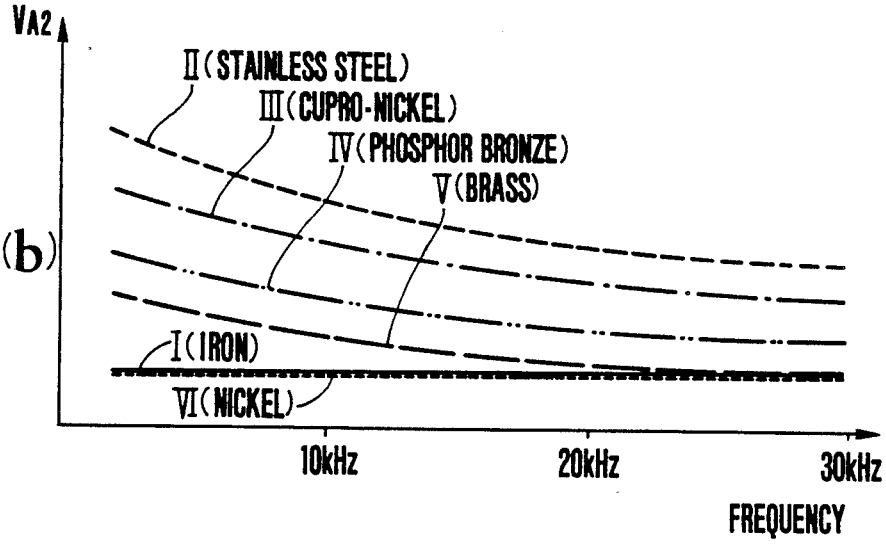

Such material characteristics noticeably appear in the AC magnetic field at a relative low frequency, as shown in FIG. 7. However, the primary characteristic (FIG. 7(*a*)) and the secondary characteristic (FIG. 7(*b*)) appear in slightly different ways. In FIGS. 7(*a*) and 7(*b*), curve I indicates iron; II, stainless steel; III, cupronickel; IV, phosphor bronze; V, brass; and VI, nickel. From the comparison between the primary and secondary characteristics, the respective materials can be easily discriminated.

Similarly, when the rolling coin 2 passes by the detection surface of the coil B1, the impedance of the coil B1 is changed in accordance with the material of the coin and a distance from the detection surface of the coil B1 to the coin surface, in other words, the thickness of the coin. Upon a change in impedance, an output amplitude of the oscillator 31 is changed, and a rectified output voltage $V_{B1}$ is also changed, as shown in FIG. 6(*c*). A minimum level $V_T$ in this case is given as a thickness characteristic level.

When the rolling coin 2 passes by the detection surfaces of the first and second oscillation coils, coil outputs change in accordance with the areas of the coin covering the detection surfaces. In this case, a timing at which changes in impedances of the coils coincide with each other changes in accordance with the diameter of a coin. In this embodiment, a level $V_D$ at which the output voltage $V_{A1}$ from the coil A1 coincides with the output voltage $V_{B1}$ from the coil B1 is given as a diameter characteristic level for a given material and thickness. Note that in this embodiment, a flat level of the voltage $V_{A1}$ shown in FIG. 6(*a*) is set to be equal to that of the voltage $V_{B1}$ shown in FIG. 6(*c*). This level is adjusted when the apparatus is delivered from the plant.

Referring to FIG. 1, reference numeral 50 denotes a controller comprising a processor unit (to be referred to as a CPU hereinafter) 51 such as a microprocessor. As will be described later, the controller 50 controls various sections while accessing a predetermined area of a RAM (random access memory) 52B in accordance with a program prestored in a ROM (read only memory) 52A. More specifically, the controller 50 detects characteristic data of an inserted coin, discriminates authenticity and denomination of the inserted coin from data stored in an EPROM (electrically programmable read only memory) 52C. The coin which is discriminated as an authentic coin is accumulated in an accumulation path. In this embodiment, the present invention is applied to a coin discrimination unit of a public telephone. When an authentic coin is accumulated, a signal indicating the denomination of the coin is output to a main CPU (not shown) of a telephone unit through a transmission line. Note that reference numeral 53 denotes an A/D converter for converting output voltages from the sensors into digital data and fetching the digital data; and 54, a channel control circuit therefor. Reference numeral 55 denotes a coin insertion detector. The detector 55 comprises a photocoupler arranged above the coils A1, A2, and B1, and detects coin insertion. A passage detector 56 also comprises a photocoupler, and detects entrance of the coin into the accumulation path. Reference numeral 57 denotes a circuit for driving a selector lever for guiding the inserted coin into the accumulation path. When the inserted coin is discriminated as a counterfeit coin, the selector lever is not operated, and the coin is automatically returned to a return slot. Reference numeral 58 denotes a sensor power supply circuit for controlling the power supplies of the sensor circuits 10 to 40.

The discrimination operation will now be described in detail with reference to FIGS. 8 and 9.

Figure 8:
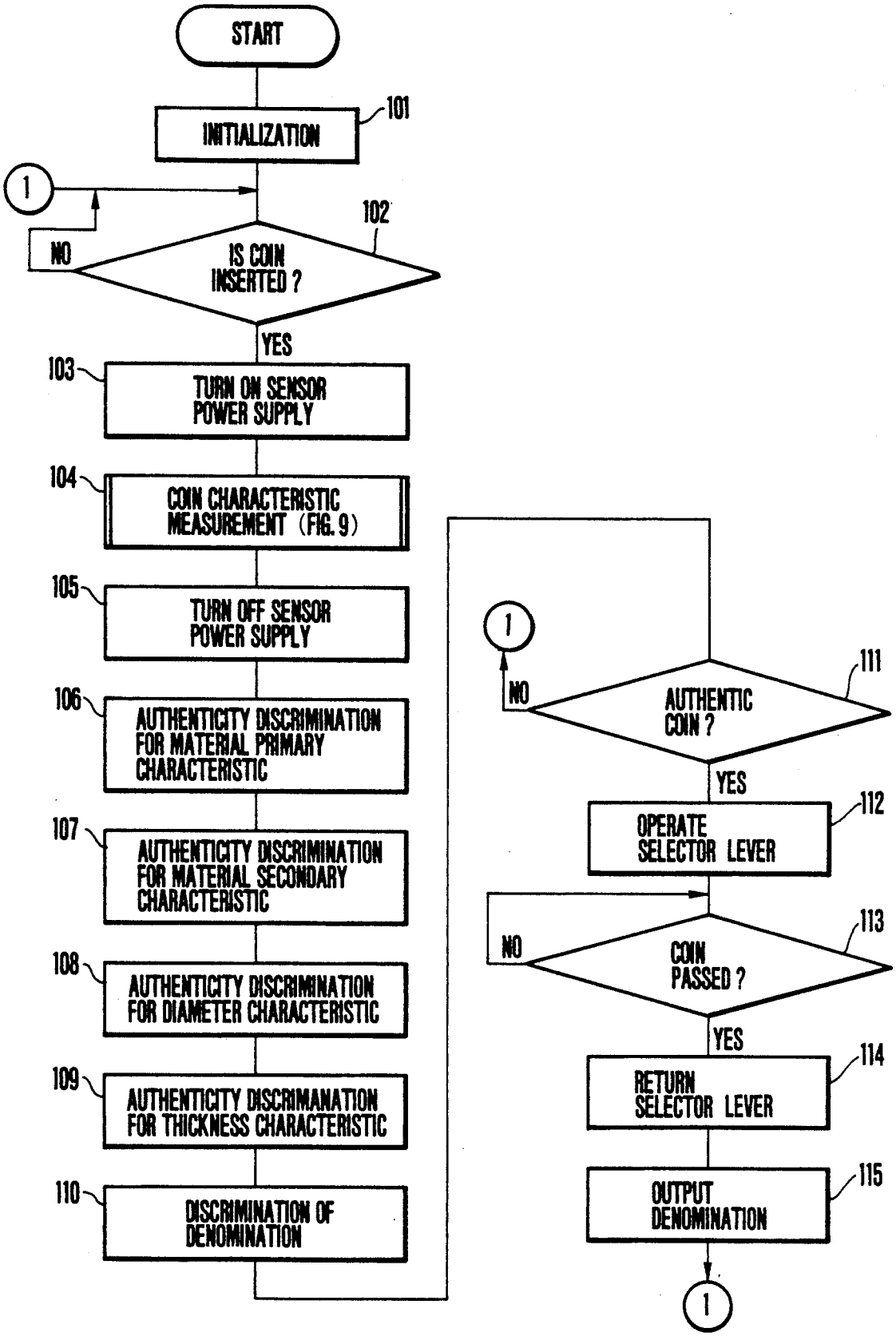
FIGS. 8 and 9 are flow charts.

Referring to FIG. 8, after initialization (step 101), the CPU 51 awaits insertion of a coin. When a coin insertion is detected by the coin insertion detector 55 (step 102), the power supplies of the sensor circuits are turned on (step 103), and coin characteristics are measured (step 104).

In this coin characteristic measurement routine, outputs $V_{A1}$, $V_{A2}$, and $V_{B1}$ from the respective sensor circuits 10 to 30 are periodically A/D converted and fetched. Then, data of the above-mentioned material primary characteristic, the material secondary characteristic, the thickness characteristic, and the diameter characteristic are detected from the converted data. The coin characteristic measurement routine program will now be described with reference to FIG. 9.

Figure 9:
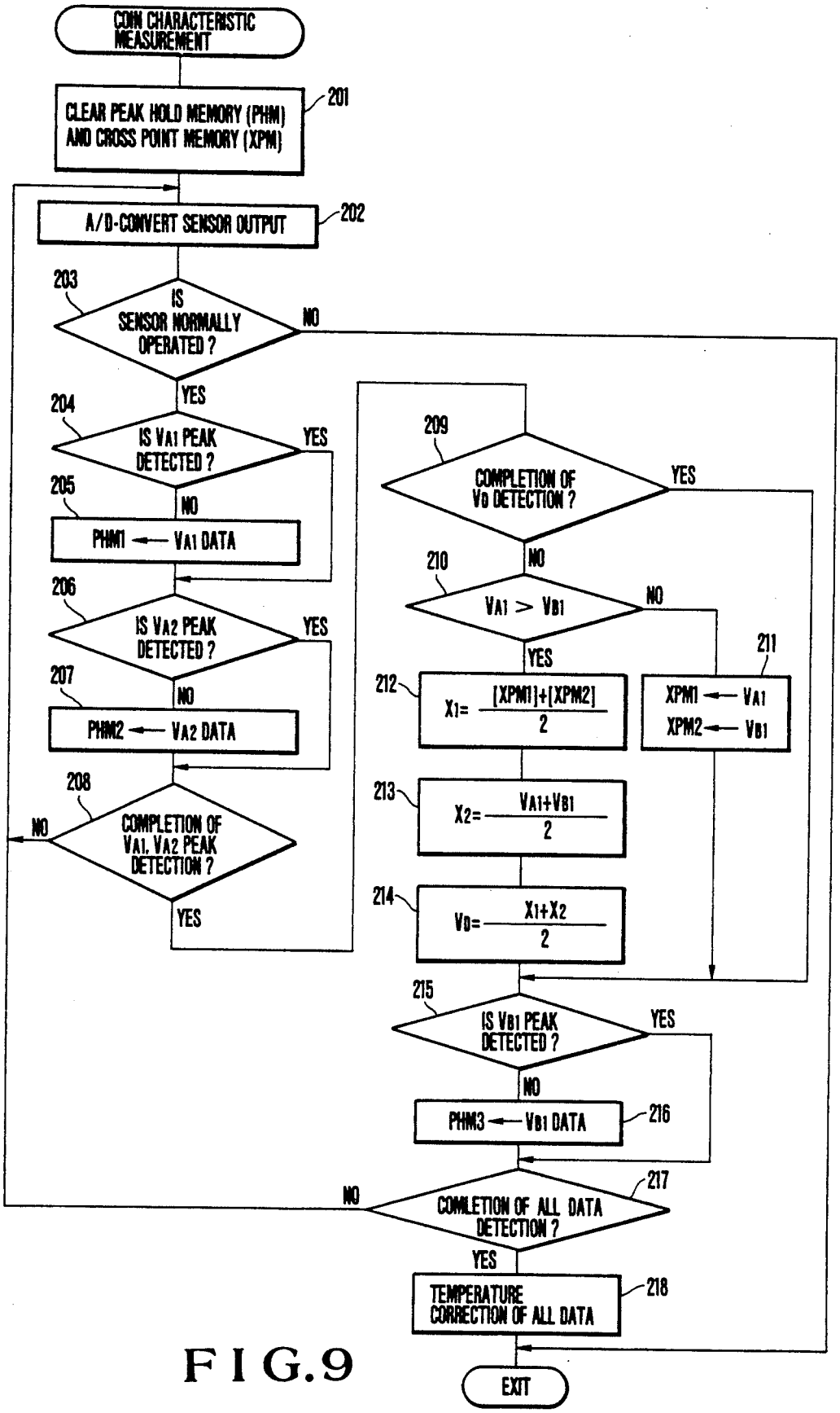

Referring to FIG. 9, when the execution of the program enters the coin characteristic measurement routine, the CPU 51 clears all the areas of a peak hold memory PHM and a cross point memory XPM allocated in predetermined areas of the RAM 52B (step 201), and thereafter, performs A/D conversion of the sensor circuit outputs (step 202). First, the channels of $V_{A1}$ and $V_{A2}$ are selected to perform A/D conversion in order to detect the material characteristic level. After it is confirmed by checking a constant output level that the sensor circuits are normally operated without any abnormality such as disconnection (step 203), if the detection value of the output voltage $V_{A1}$ of the sensor circuit 10 does not reach a peak value (step 204), data $V_{A1}$ is stored in a first peak hold memory PHM1 (step 205). Similarly, if the detection value of the output voltage $V_{A2}$ does not reach a peak value (step 206), data $V_{A2}$ is stored in a second peak hold memory PHM2 (step 207). As long as the peak values of $V_{A1}$ and $V_{A2}$ are not both detected (step 208), $V_{A1}$ and $V_{A2}$ are repetitively fetched, and the contents of the peak hold memories are updated until the peak values are detected.

After the peak values $V_{M1}$ and $V_{M2}$ of $V_{A1}$ and $V_{A2}$ are detected (step 208), the CPU 51 compares $V_{A1}$ and $V_{B2}$ (step 210) until the diameter characteristic level $V_D$ is detected (step 209). While $V_{A1}<V_{B1}$, the CPU 51 stores the data $V_{A1}$ and $V_{B1}$ respectively in first and second cross point memories XPM1 and XPM2 (step 211), thereby updating the contents of the cross point memories. When $V_{A1}>V_{B1}$ (step 210), an average $X_1$ is calculated from the detection values $V_{A1}$ and $V_{B1}$. The detection values $V_{A1}$ and $V_{B1}$ are stored in the first and second cross point memories XPM1 and XPM2 (step 212). Similarly, an average $X_2$ is calculated from the detection values $V_{A1}$ and $V_{B1}$ when $V_{A1}>V_{B1}$ (step 213). An average of the averages $X_1$ and $X_2$ is calculated and is set as $V_D$ (step 214).

Until a peak value of $V_{B1}$ is detected (step 215), values of $V_{B1}$ are stored in a third peak hold memory PHM3 to update its content (step 216).

In this manner, when data detection for four types of characteristics is completed (step 217), the CPU 51 performs temperature correction of the characteristic data (step 218). Since analog signals input to the A/D converter 53 change in accordance with an ambient temperature due to the temperature characteristics of the sensor circuits, the temperature correction is performed to compensate for this influence. The characteristic data obtained described above are converted to values at a reference temperature in accordance with a detection output voltage $V_{TMP}$ of the temperature sensor circuit 40. For this purpose, in this embodiment, correction data corresponding to respective temperatures are stored in a predetermined area of the EPROM 52C in units of blocks for the material primary characteristic, the material secondary characteristic, the diameter characteristic, and the thickness characteristic, so that specific temperatures correspond to specific addresses.

Therefore, when certain characteristic data for a given characteristic, e.g., the material primary characteristic is obtained and data indicating an ambient temperature at that time is obtained by A/D converting the output from the temperature sensor circuit 40, the temperature data is added, as a lower bit, to a block address indicating a block storing the temperature correction data for the detected material primary characteristic, thereby creating address data. With this address data, a predetermined area of the EPROM 52C is designated (ADD represents an address bus therefor). Since the predetermined area stores data indicating that a predetermined value is to be subtracted from or added to the detection data, the data is read out, and correction corresponding to the content of the data is performed. This operation is performed for the respective characteristic data, thereby obtaining the corrected data.

After the coin characteristic measurement is completed (step 104 in FIG. 8), the sensor power supplies are turned off (step 105), and authenticity discrimination is performed for the respective characteristics (steps 106 to 109). The authenticity discrimination is performed as follows. In this embodiment, data indicating allowances of characteristic data, i.e., indicating whether or not the characteristics of a coin fall within the allowance of, e.g., an authentic 100 Yen coin is stored in four blocks in the EPROM 52C corresponding to the respective characteristic data, so that a specific characteristic data value corresponds to a specific address. More specifically, upper 3 bits of this data respectively correspond to 100 Yen, 50 Yen, and 10 Yen coins. If the characteristic data value corresponding to the address falls within the allowance of, e.g., a 100 Yen coin, the MSB is set to be "0". If the data value falls within the allowance of, e.g., a 50 or 10 Yen coin, the second or third significant bit is set to be "0". The remaining bits are set to be "1".

Therefore, when given characteristic data is obtained for a certain characteristic, e.g., the material primary characteristic, the characteristic data is added to a block address indicating a block storing allowance data for the material primary characteristic as lower bits to complete address data. With this address data, a predetermined area of the EPROM 52C is designated, and the data stored therein is read out.

When four data are read out in this manner, the CPU 51 totally checks these four data and discriminates the denomination of the coin (step 110). In this embodiment, this discrimination is performed as follows. Logical sums of the four data are calculated in units of bits. For example, in the case of a 100 Yen coin, the data "0" is set in the MSBs of these four data. As a result, the logical sum of the MSBs is "0". Therefore, if the MSB is "0", the coin is determined to be a 100 Yen coin. Similarly, if the second significant bit is "0", the coin is determined to be a 50 Yen coin, and if the third significant bit is "0", the coin is determined to be a 10 Yen coin. Note that the above discrimination method is described in detail in U.S. Ser. No. 738,124 filed on May 24, 1985 by the same applicant and now patented as U.S. Pat. No. 4,660,705.

If only one of the upper three bits corresponding to the denominations of coin is "0", the coin is discriminated as an authentic coin corresponding to the bit position (step 111). In this case, the CPU 51 immediately operates the selector lever (step 112) and confirms that the coin proceeds toward the accumulation path (step 113). Thereafter, the CPU 51 returns the selector lever (step 114), and outputs data indicating the denomination of the accumulated coin to the main processor (step 115). The main processor can determine the total amount of accumulated coins, so that it can display this amount or when a communication fee obtained by multiplying a charging frequency with a unit communication fee exceeds the total amount of accumulated coins, the communication can be forcibly disconnected.

If the logical sum data of the four data do not include bit "0" or include two or more bits "0", the coin is discriminated as a counterfeit coin (step 111). In this case, the selector lever is not operated, and the coin is automatically returned. When coins to be processed are formed of a ferromagnetic material, only the sensor circuit 10 is used. When coins are formed of a material other than the ferromagnetic material, the sensor circuit 20 is used. When coins formed of a ferromagnetic material and other materials are both used, both the circuits 10 and 20 are used. In the above embodiment, the detection outputs are corrected in accordance with the output from the temperature sensor circuit Instead, address assignment of the memory can be changed.

According to the present invention as described above, a coin is totally discriminated while relating discrimination factors of a material, a thickness, and a diameter to each other. As a result, a probability of erroneous discrimination such that a counterfeit coin is discriminated as an authentic coin can be reduced.

The present invention is not limited to the above embodiments, and various changes and modifications may be made within the spirit and scope of the invention. For example, in FIG. 6(*a*), the value $V_{M1}$ is directly used as a maximum or minimum level which is detected as a material primary characteristic level. However, the maximum or minimum level can be a value associated with a maximum change when the coin passes. Therefore, the maximum or minimum level can be a change from the flat level or a change from a reference level. This also applies to $V_{M2}$ shown in FIG. 6(*b*) and $V_1$ shown in FIG. 6(*c*). This modification is made for peak value discrimination, but can be applied to a coincidence operation using FIGS. 6(*a*) and 6(*b*).

What is claimed is:

1. A coin discrimination apparatus which determines authenticity and a denomination of a coin by oscillating magnetic fields of high and low frequencies in a low frequency band in which the generated magnetic fluxes pass through a coin, comprising:

first and second oscillators, for generating low and high frequency signals, the frequencies of both said signals being within a low frequency band whereby fields generated from said signals pass through coins;

a first oscillation coil, arranged at a coin contact surface of an inclined coin path, and connected to said first oscillator for generating an oscillating magnetic field at said low frequency, the impedance of said first oscillator coil changing upon the passage of a coin, said change being indicative of a material characteristic of a coin;

a reception coil arranged at a non-contact surface of said inclined coin path and facing said first oscillation coil for sensing changes in said low frequency oscillating magnetic field upon the passage of a coin;

a second oscillation coil, which is arranged on the coin non-contact surface and separated from the reception coil by a predetermined distance in a coin rolling direction, and connected to said second oscillator for generating an oscillating magnetic field at said high frequency, the impedance of said second oscillation coil changing upon the passage of a coin, said change being indicative of said coin's thickness;

maximum change detecting means for detecting respective values in relation to maximum values of said changes in impedances and fields of said oscillation coils and said reception coil upon passage of a coin;

change detecting means for detecting a value in relation to changes in impedances of said first and second oscillation coils when the changes in the impedances thereof coincide with each other as an indication of coin diameter; and discriminating means for determining authenticity and the denomination of the coin based on coin physical characteristics in accordance with the detection results from said maximum change detecting means and said change detecting means.

2. An apparatus according to claim 1, wherein said discriminating means performs total determination of coin value based on two outputs from said maximum value detecting means and one output from said coincidence detecting means in accordance with physical characteristics, i.e., a material, a thickness, and a diameter of the coin.

3. An apparatus according to claim 1, further comprising a memory prestoring data indicating a value, corresponding to physical characteristics at bit positions corresponding to denominations of coins in units of addresses, said discriminating means designating an address of said memory in accordance with the outputs from said detecting means, and performing discrimination based on the readout bit logic from the designated address.

4. An apparatus according to claim 1, further comprising temperature sensor means for outputting temperature data, said discriminating means modifying the outputs of said maximum change detecting means and said change detecting means based on the output of said temperature sensor means and making its determination based on data subsequent to said modifications.

5. An apparatus according to claim 1, wherein the difference in frequencies between the high and low frequency is about 12 to 13 kHz.

6. An apparatus according to claim 1, wherein said maximum value detecting means comprises a rectifier for rectifying and smoothing an AC output from said coils, an A/D converter for converting the output from said rectifier into digital data, and means for detecting a peak value of the digital output from said A/D converter which changes over time.

7. An apparatus according to claim 1, wherein said change detecting means comprises a rectifier for rectifying and smoothing an AC output from said coils, an A/D converter for converting the output from said rectifier into digital data, and means for detecting a value when two digital outputs from said A/D converter which change over time coincide with each other.

* * * * *